US005311970A

United States Patent [19]

Basta

[11] Patent Number: 5,311,970

[45] **Date of Patent: * May 17, 1994**

[54] LOW-PROFILE WATERCRAFT LIFT

[76] Inventor: Samuel T. Basta, 2457 - 137th Ave. SE., Bellevue, Wash. 98005

[ * ] Notice: The portion of the term of this patent subsequent to Sep. 1, 2009 has been disclaimed.

[21] Appl. No.: 938,274

[22] Filed: Aug. 31, 1992

Related U.S. Application Data

[63] Continuation of Ser. No. 689,301, Apr. 22, 1991, Pat. No. 5,143,182.

[51] Int. Cl.[5] ..... B66B 9/20

[52] U.S. Cl. ..... 187/11; 187/26; 187/27; 114/44; 114/48

[58] Field of Search ..... 187/1 R, 8.59, 11, 20, 187/26, 27, 34, 73, 95; 114/44, 45, 48; 405/3, 4; 414/921

[56] References Cited

U.S. PATENT DOCUMENTS

| | | | |
|---|---|---|---|
| 3,088,545 | 5/1963 | Meyer | 187/27 X |
| 3,362,172 | 1/1968 | Rutter | 405/4 X |
| 4,024,972 | 5/1977 | Hobson | 187/95 X |
| 4,222,140 | 9/1980 | Olewinski et al. | 187/73 X |
| 4,671,729 | 6/1987 | McFarland | 414/921 X |
| 4,934,298 | 6/1990 | Pritchett | 114/44 |
| 4,983,067 | 1/1991 | Montgomery | 114/44 X |
| 5,143,182 | 9/1992 | Basta | 187/11 |
| 5,158,419 | 10/1992 | Kempf et al. | 414/921 X |

*Primary Examiner*—D. Glenn Dayoan
*Assistant Examiner*—Dean A. Reichard
*Attorney, Agent, or Firm*—Trask, Britt & Rossa

[57] ABSTRACT

A heavy duty low-profile watercraft lift (10) for lifting small watercraft into and out of the water adjacent to a dock (12). The lift (10) comprises a single heavy-duty column (22) having a winch (28) mounted on the top thereof for raising and lowering a carriage (26) that is engaged with a track (32) formed on the column (22). Adjustable arms (72) and rails (74) on the carriage (26) enable adjustment to fit a watercraft. Opening (108) allows a pin to be inserted therethrough to hold the carriage (26) in a raised position. The winch (28) can be mounted to any side of the column (22) to meet the needs of a particular installation. The lift (10) of the present invention provides a compact, efficient, and visually appealing dockside lift.

5 Claims, 3 Drawing Sheets

FIG. 2
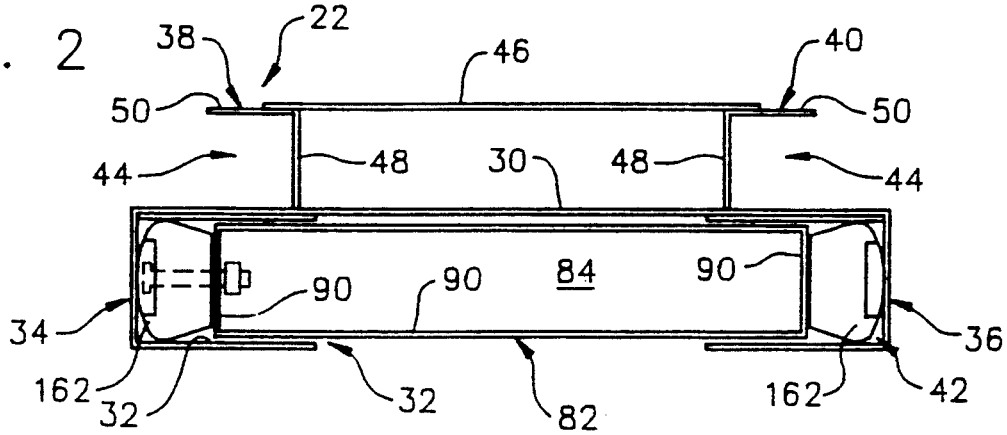
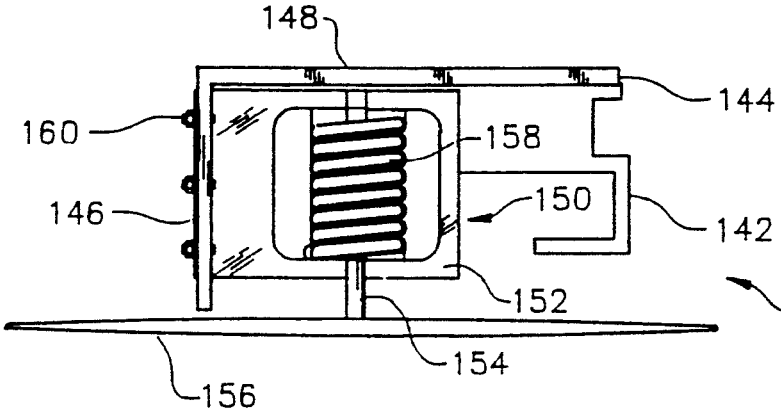
FIG. 4A
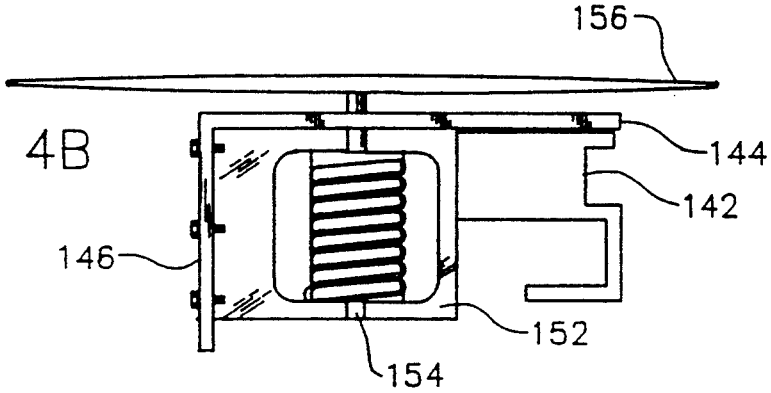
FIG. 4B
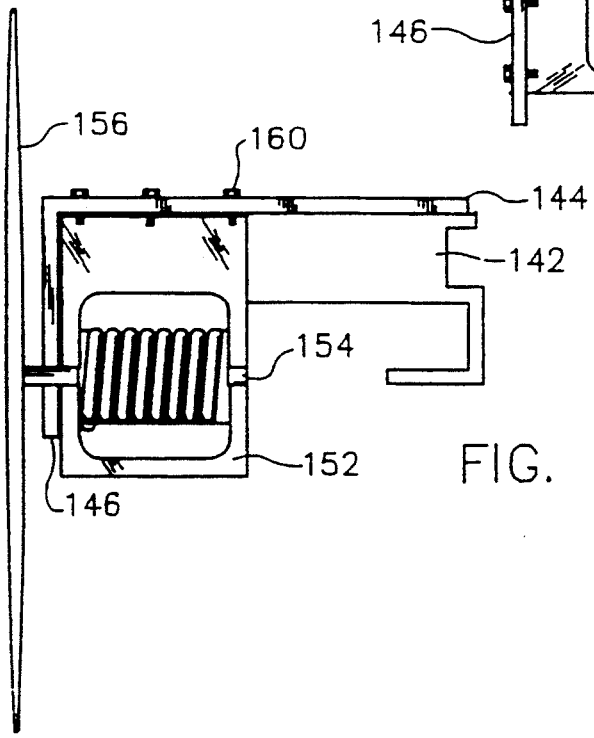
FIG. 4C

LOW-PROFILE WATERCRAFT LIFT

This is a continuation of application Ser. No. 07/689,301 filed Apr. 22, 1991, now U.S. Pat. No. 5,143,182.

TECHNICAL FIELD

The present invention pertains to lifts, and, more particularly, to a low-profile, compact, heavy duty lift for lifting jet skis and other small watercraft into and out of the water.

BACKGROUND OF THE INVENTION

Owners of waterfront property typically own one or more personal watercraft that are utilized for sport and pleasure. These watercraft can include small boats, canoes, dinghies, jet skis, and other powered and non-powered marine craft. Most owners of waterfront property have docks extending from the shore into the body of water to allow easy access to the watercraft. In addition, these docks are used to moor the watercraft for safe storage when not in use.

It is frequently desirable to have a watercraft removed from the water for storage instead of leaving it moored to the dock. For instance, rough weather can cause significant wave action that will force the watercraft to repeatedly crash into the dock. In addition, watercraft such as jet skis are more properly stored outside of the water because their low profile in the water makes them more susceptible to water damage.

A number of devices have been developed to assist the users and owners of these watercraft in lifting the watercraft out of the water. For instance, U.S. Pat. No. 4,900,187 discloses a hydraulic actuator and lift apparatus that is mounted adjacent to a dock for lifting a small watercraft from the water. As is typical of commercially available lifts today, this device has a rectangular-shaped stationary frame that includes upright legs or rails that are mounted on the dock to extend down into the water. Cross support beams are attached to the rails and to the bottom of the dock to provide rigid support. A hydraulic actuator is mounted to the frame under the water for moving a platform up and down on the frame. While the top of the rails in this patent are substantially flush with the top of the dock, other devices extend the rails above the dock to enable lifting of a watercraft higher than the dock. The drawbacks to these lifts presently in use is that they are complex and cumbersome. Installation frequently requires access to underneath the dock securing the rails to the ground beneath the water, and present an unsightly appearance. Many of these lifts lack the capability of easily adjusting their vertical height to accommodate changes in water levels that can result from tides, run-off, drought, etc. In addition, the actuator mechanism is frequently submerged, reducing its life and making it difficult to adjust or repair the mechanism.

SUMMARY OF THE INVENTION

The present invention is directed to a low-profile, compact, heavy duty lift used in combination with a dock on a body of water for lifting jet skis and other small watercraft into and out of the water. The lift comprises a column having a track formed thereon; a base for mounting the column to the dock such that the column is positioned in a vertical orientation; a carriage adapted to ride on the column between a lowered first position and a raised second position; a pair of rails associated with the carriage for cradling a watercraft; and a prime mover such as a winch for moving the carriage on the column to raise and lower the watercraft into and out of the water.

In accordance with another aspect of the present invention. the column includes means thereon such as aligned openings that permit adjustment in the vertical mounting position of the column on the base.

In accordance with another aspect of the present invention, a mounting bracket having a unique configuration is used for attaching the winch to the central top portion of the column such that the winch can be positioned at one of at least three orientations to enable easy access for a user.

In accordance with still yet another aspect of the present invention, the lift includes stops positioned at the top and bottom of the track on the column for limiting the travel of the carriage on the column and a locking member for locking the carriage at any selected position on the column. position on the column.

As will be readily appreciated from the foregoing description, the present invention provides a unique lift having a low-profile single track that has a pleasing appearance. The lift is easily mounted to a dock and adjustable in its vertical position. Furthermore, the present invention provides a unique winch mounting system that places the winch directly at the top of the column and allows for positioning the winch in at one of at least three orientations to enable easy access for a user. Other unique features include the ability to lock the carriage at any position on the track, travel limiters at the top and bottom of the column to prevent the carriage from leaving the track, and the mechanical advantage achieved by using a pulley sheave on the carriage through which the winch cable rides to enable lifting of greater loads. Finally, the use of a single column with a single track thereon not only uses a smaller area on the dock, but is easier and less costly to manufacture because of fewer material requirements. Consequently, the present invention achieves a heavy-duty, compact, efficient, less costly lift that is easily adapted by users to suit their needs and preferences.

BRIEF DESCRIPTION OF THE DRAWINGS

The foregoing and other features and advantages of the present invention will be more readily appreciated as the same becomes better understood from the detailed description when taken in conjunction with the following drawings, wherein:

FIG. 2 is a top view of one embodiment of the column formed in accordance with the present invention;

FIGS. 4A–4C are top plan views illustrating further alternative winch mounting positions.

DETAILED DESCRIPTION OF THE PREFERRED EMBODIMENT

Figure 1:
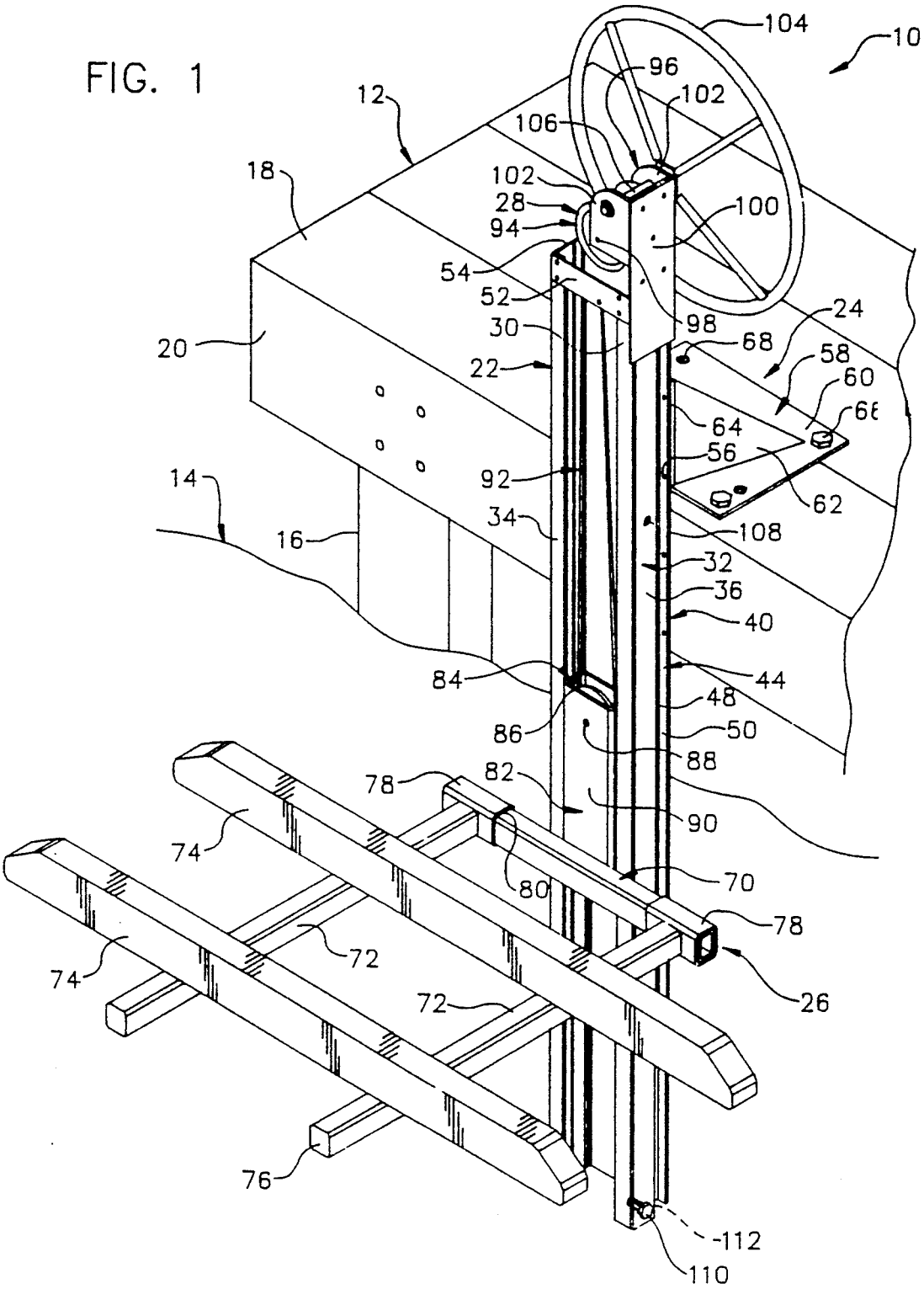
FIG. 1 is an isometric view of a heavy duty low-profile watercraft lift formed in accordance with the present invention.

Referring initially to FIG. 1, illustrated therein is a heavy duty low-profile lift 10 formed in accordance with the present invention mounted on a dock 12 that extends into a body of water 14. The body of water 14 can be a lake, river, or ocean. The dock 12 is supported by an upright support 16 that is attached to the top surface 18 of the dock 12 and a side wall 20 of the dock 12. It is to be understood that the present invention can be mounted on pier, wharf, bulkhead or sea wall, as well as a dock 12.

The lift 10 itself comprises generally an upright tower or column 22 attached to the dock 12 by a base 24 and having a carriage 26 mounted to ride on the column 22. A winch 28 is mounted on top of the column 22 for moving the carriage 26.

Referring next to FIGS. 1 and 2, the column 22 is formed to have an elongate central partition 30 on one side of which is formed an elongate track 32 consisting of a first guide 34 and second guide 36 formed on each elongate edge of the partition 30. On the other side of the partition 30 are an elongate first flange 38 and an elongate second flange 40 formed in spaced parallel relationship along the length of the partition 30. The first and second guides 34 and 36 are formed of U-shaped channels that are positioned such that the channels face each other to define a substantially rectangular enclosure 42 with an open outer wall through which the carriage 26 projects.

The first and second flanges 38 and 40 are formed on the opposite side of the partition 30 from the track 32. The flanges 38 and 40 are L-shaped and are formed on the partition 30 or attached to the partition 30 such that open U-shaped channels 44 are formed to open outward or away from each other along the length of the partition 30. The first and second flanges 38 and 40 may be attached to each other by a plate member 46 to provide rigidity and strength. This plate member 46 may also be integrally formed with the flanges 38 and 40 and the partition 30. The first and second flanges 38 and 40 each include a stem 48 projecting outward from the partition 30 and a leg 50 formed at substantially a right angle to the stem 48 to project outward away from the center of the partition 30. As such, the first and second flanges 38 and 40 form the channels 44 that open away from each other. As shown in FIG. 1, a crossbar 52 is attached across the track 32 at the top 54 of the column 22.

The column 22 is attached to the base 24 through openings 56 formed in the leg 50 of the first and second flanges 38 and 40. Additional openings 56 in the leg 50 enables securing of the column 22 to the side wall 20 of the dock 12 and enable mounting of the column 22 at various heights or vertical positions on the base 24. This allows a user to accommodate various dock heights and water levels.

The base 24 comprises a bottom plate 58 having upright flanges 62 on the top surface 60 thereof that in turn are attached to or integrally formed with a mounting plate 64 that is sized and shaped to mate with the first and second flanges 38 and 40 on the column 22. Fasteners 66 projecting through openings 68 in the bottom plate 58 securely attach the base 24 to the top surface 18 of the dock 12.

The carriage 26 consists of a support bar 70 having a pair of arms 72 projecting therefrom at substantially a right angle. Mounted on top of the arms 72 in perpendicular relationship to the arms 72 are a pair of bunks or rails 74 positioned in spaced parallel relationship. The support bar 70 and arms 72 may be formed of high-strength metal tubes with the open ends 76 sealed to prevent water corrosion. T-fittings 78 are formed on one end of the arms 72 and are sized and shaped to be slidably received over the ends 80 of the support bar 70. Ideally, the T-fittings 78 are fixed in position on the support bar 70 with suitable fasteners that enable adjustment of the position of the arms 72 on the support bar 70. Similarly, the rails 74 may be attached to the arms 72 by means of fasteners projecting through the arms 72 and the rails 74 or by means of U clamps, etc. In this manner, the rails 74 can be adjustably positioned along the length of the arms 72. This enables sizing of the space between the rails 74 to accommodate the size and shape of the watercraft to be raised and lowered.

The support bar 70 is attached to a carrier 82 that is sized and shaped to be slidably mounted within the track 32 on the column 22. More particularly, the carrier 82 is in the shape of a rectangular box having a hollow interior 84. The carrier may be carried by means of slide blocks or rollers 162 on the track 32. The support bar 70 is attached to the carrier 82 by suitable fasteners. Mounted within the hollow interior 84 of the carrier 82 is a pulley sheave 86. The pulley sheave 86 freely rotates about an axle 88 mounted in the walls 90 of the carrier 82.

A cable 92 passes around the pulley sheave 86. The cable 92 has one end affixed to the top 54 of the column 22 and the other end connected to the winch 28. The winch 28 includes a spindle 94 mounted to a bracket 96 for rotation about a horizontal axis 98. The bracket 96 comprises a mounting plate 100 having two parallel ears 102 projecting outward horizontally therefrom. The spindle 94 is mounted between the ears 102 and has the cable 92 attached thereto. A spoked wheel 104 is mounted on the end of a shaft 106 that is received through the ears 102 and is connected to the spindle 94 by gears (not shown). As such, rotation of the spoked wheel 104 rotates the spindle 94, causing the cable 92 to be wound up or unwound on the spindle 94 such that the carrier 82 is moved along the track 32 to thereby move the carriage 26 up and down along the column 22.

The mounting plate 100 of the winch 28 is attached to the top of the column 22 such that the wheel 104 is facing the dock 12. However, the mounting plate 100 may be positioned on the column 22 on one of the adjacent sides to the side shown such that the wheel 104 will be positioned 90 degrees to the left or right of the column 22. This enables a user to position the wheel 104 to meet the needs of a particular application. Alternative mounting positions for the winch 28 are discussed more fully hereinafter below.

An opening 108 is formed on the track 32 to enable insertion of a pin or fastener when the carrier 82 is positioned above the opening 108 to lock the carriage in a raised position. Similarly, a fastener 110 is positioned in an opening 112 at the bottom of the track 32 to prevent the carrier 82 from becoming disengaged from the track 32. The fastener 110 is positioned far enough below the level of the water 14 to enable the carriage 26 to be lowered below the watercraft so that the watercraft can float without interference from the carriage 26.

For installation, the lift 10 is initially assembled to have the column 22 attached to the base 24. The assembled column 22 and base 24 are attached to the top surface 18 and side wall 20 of the dock 12. The carrier 82 is then engaged with the track 32 by placing it through the open top of the column 22. A pin can be placed through the opening 108 to hold the carrier 82 in a raised position during assembly. The cable 92 is passed around the pulley sheave 86 and connected to the top of the column 22 and the spindle 94. The winch 28 is then attached in place by fastening the mounting plate 100 to the appropriate side of the column 22. The pin is the removed from the opening 108 to permit free movement of the carrier 82 on the track 32.

In operation, turning of the spoked wheel 104 causes the cable to be wound and unwound on the spindle 94. When the cable is wound on the spindle 94, the carrier 82 is pulled up the track 32 to raise the carriage from a lowered position at the bottom of the column 22 to a raised position at the top of the column 22. Openings in addition to opening 108 may be formed in the track 32 to allow a pin to be placed at any point along the track 32 to hold the carriage at a predetermined position. The arms 72 and rails 74 are adjustably positioned to form a cradle in which the watercraft can rest without danger of tipping or falling off.

Figure 3:
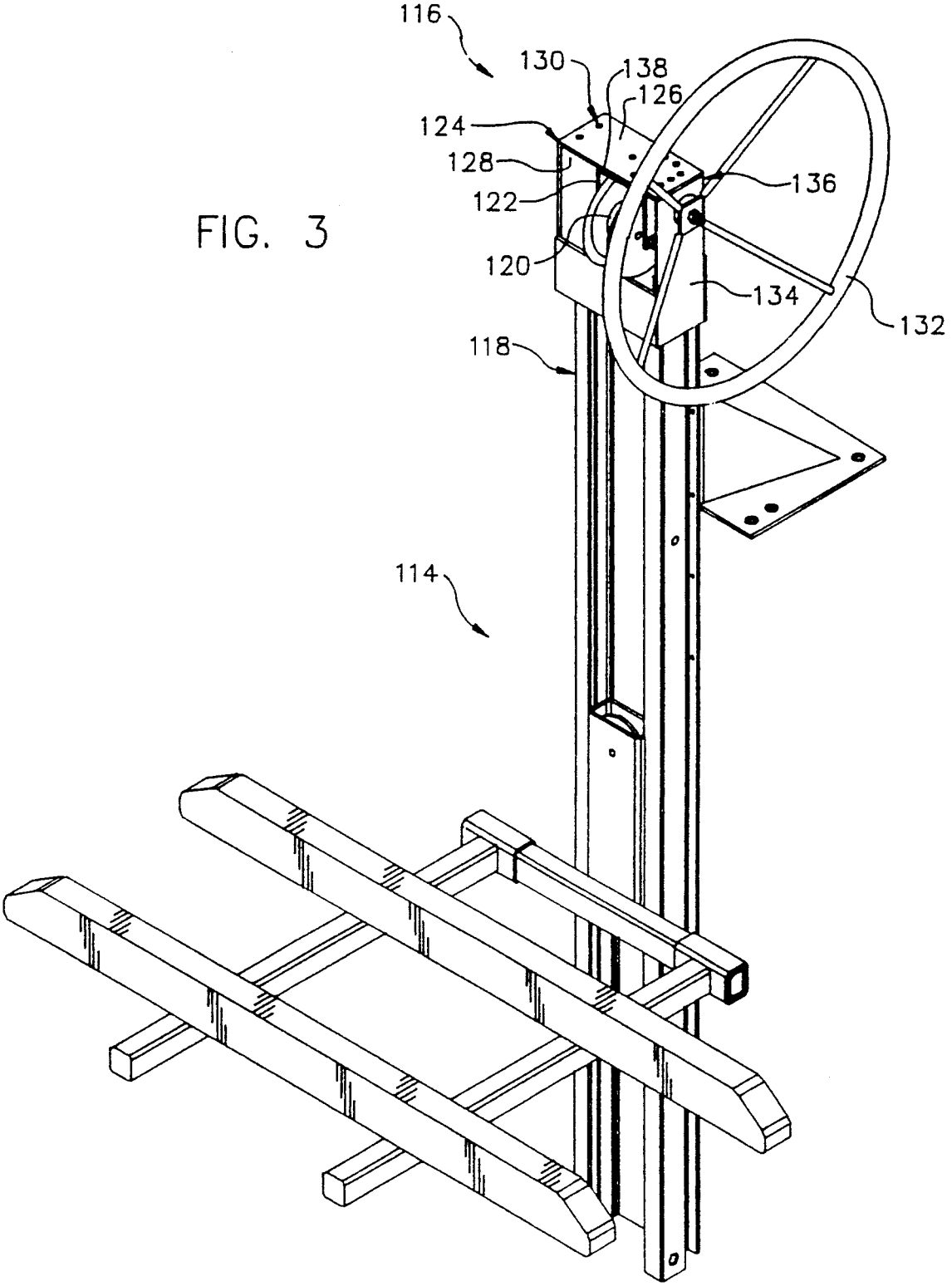
FIG. 3 is an isometric view of an alternative embodiment of the lift illustrating an alternative mounting for the winch on the column top.

While a preferred embodiment of the invention has been illustrated and described, it is to be understood that various changes can be made therein without departing from the spirit and scope of the invention. For instance, FIG. 3 illustrates an alternative mounting position for the winch 28. As illustrated therein, the lift 114 has a winch 116 mounted to the top of the tower or column 118. The winch 116 includes a spindle 120 rotatably mounted in a U-shaped spindle bracket 122 that in turn is attached to a mounting bracket 124. The mounting bracket 124 includes a top plate 126 integrally formed with a side plate 128 that in turn is attached to the column 118. The top plate 126 includes a plurality of openings 130 for mounting of the spindle bracket 122 thereto.

The spoked wheel 132 is rotatably mounted to a shaft (not shown) that extends through an upright leg 134 on an L-shaped attachment bracket 136. The upright leg 134 is integrally formed with a horizontal leg 138 that projects underneath the top plate 126 of the mounting bracket 124. As described above with respect to the embodiment illustrated in FIG. 1, the wheel 132 is geared to the spindle 120 such that rotation of the wheel 132 rotates the spindle 120. The spindle bracket 122 is attached to the horizontal leg 138 of the L-shaped attachment bracket 136 such that the wheel 132, spindle 120, and attachment bracket 136 form a single unit.

The orientation of the wheel 132 and spindle 120 with respect to the column 118 can be altered by repositioning the attachment bracket 136 in its mounting to the mounting bracket 124. For instance, the attachment bracket 136 can be rotated counterclockwise 90 degrees to realign with the openings 130 in the top plate 126 and attached thereto with suitable fasteners. In this manner, the wheel 132 can be positioned over a dock instead of out over the water.

FIGS. 4A–4C illustrate yet another alternative embodiment of a lift 140 formed in accordance with the present invention wherein the tower or column 142 has an L-shaped mounting bracket 144 attached to the top thereof. The L-shaped bracket 144 includes a long leg 148 and a short leg 146 projecting at a right angle from the long leg 148. The winch 150 includes a frame 152 having a spindle 154 rotatably mounted therein that includes a wheel 156 attached to one end thereof. Rotation of the wheel 156 rotates the spindle 154 to cause the cable 158 to be wound and unwound thereon. The winch frame 152 can be fastened with fasteners 160 to the short leg 146 such that the wheel 156 is parallel to the long leg 148 and projects away from the short leg 146, as illustrated in FIG. 4A. FIG. 4B illustrates the frame 152 mounted in an inverted position with respect to FIG. 4A wherein the wheel 156 is adjacent the long leg 148 of the L-shaped mounting bracket 144. In this position, the wheel 156 would be mounted over a dock. Alternatively, the frame 152 can be fastened with fasteners 160 to the long leg 148 of the L-shaped bracket 144 such that the wheel 156 is adjacent and parallel to the short leg 146. This would be similar to the position of the wheel 132 illustrated in FIG. 3. Consequently, the invention is to be limited only by the scope of the claims that follow.

The embodiments of the invention in which an exclusive property or privilege is claimed are as follows:

1. A low-profile lift for jet skis and other small watercraft for use in combination with a dock positioned in a body of water and having a top surface and a side wall, the lift comprising:

A column:

means for carrying a watercraft, said carrying means adapted to ride on said column;

a rigid means for affixing said column to only the top surface of the dock and adjacent the side wall of the dock such that said column is oriented substantially perpendicular to the dock to extend above the dock and below the dock into the body of water without contacting the side wall of the dock, said affixing means comprising a rigid base plate for fixed attachment to the top surface of the dock, an upright member extending from said base plate for attachment to said column, and at least one reinforcing member attached to said base plate and said upright member for preventing tilting of said elongate guide means and for transferring all forces exerted on said guide means by said carrying means to the top surface of the dock; and means for moving said carrying means on said column such that the watercraft on said carrying means is raised from and lowered to the body of water.

2. The lift of claim 1, wherein said column includes an elongate track.

3. The lift of claim 2, wherein said rigid base plate comprises a first solid plate, and said upright member comprises a second solid plate affixed along one side of said rigid base plate, said rigid base plate being sized larger than said upright member.

4. The lift of claim 3, wherein said track further includes means for enabling adjustable mounting of said track on said upright member such that the vertical height of said track can be adjusted.

5. The lift of claim 4, wherein said moving means is centrally mounted on the top of said track and is angularly adjustable with respect to said track and said upright member.

* * * * *